US008474443B2

(12) United States Patent
Geno

(10) Patent No.: US 8,474,443 B2
(45) Date of Patent: Jul. 2, 2013

(54) ARROW REST WITH ARROW HOLDER

(75) Inventor: Ray Edward Geno, Macomb, MI (US)

(73) Assignee: Slate Shooting Products LLC, Macomb, MI (US)

( * ) Notice: Subject to any disclaimer, the term of this patent is extended or adjusted under 35 U.S.C. 154(b) by 728 days.

(21) Appl. No.: 12/653,434

(22) Filed: Dec. 14, 2009

(65) Prior Publication Data

US 2011/0139138 A1 Jun. 16, 2011

(51) Int. Cl.
*F41B 5/22* (2006.01)
*F41B 5/14* (2006.01)

(52) U.S. Cl.
CPC ..... *F41B 5/143* (2013.01)
USPC ..... 124/44.5; 124/88

(58) Field of Classification Search
CPC ..... F41B 5/143
USPC ..... 124/44.5, 88
See application file for complete search history.

(56) References Cited

U.S. PATENT DOCUMENTS 2,691,974 A * 10/1954 Nelson ..... 124/44.5
4,038,960 A * 8/1977 Ludwig ..... 124/44.5
4,332,232 A * 6/1982 Troncoso, Jr. ..... 124/24.1
4,407,261 A * 10/1983 Elliott ..... 124/44.5
4,577,612 A * 3/1986 Zell ..... 124/44.5
4,685,439 A * 8/1987 Cosentino, Jr. ..... 124/44.5
4,803,971 A * 2/1989 Fletcher ..... 124/44.5
4,827,895 A * 5/1989 Troncoso, Jr. ..... 124/44.5
4,898,145 A * 2/1990 Simo ..... 124/44.5
5,009,215 A * 4/1991 Ludwig ..... 124/44.5
5,107,819 A * 4/1992 Pugh ..... 124/52
5,235,958 A * 8/1993 Laffin ..... 124/44.5
5,280,777 A * 1/1994 Pugh ..... 124/52
5,341,789 A * 8/1994 Paglia ..... 124/44.5
5,454,362 A * 10/1995 Cook ..... 124/44.5
5,490,492 A * 2/1996 Savage ..... 124/44.5
5,603,309 A * 2/1997 Sheliga ..... 124/44.5
5,606,962 A * 3/1997 Troncoso ..... 124/44.5
5,611,323 A * 3/1997 Townley ..... 124/44.5
5,697,356 A * 12/1997 Chappell ..... 124/44.5
6,021,769 A * 2/2000 Troncoso ..... 124/44.5
6,035,842 A * 3/2000 Bradley ..... 124/44.5
6,142,134 A * 11/2000 Meeks ..... 124/44.5
6,390,084 B1 * 5/2002 Hulm ..... 124/44.5
6,488,018 B2 * 12/2002 Hulm ..... 124/44.5
6,591,823 B1 * 7/2003 Keller ..... 124/44.5
6,681,753 B2 * 1/2004 Afshari ..... 124/44.5
6,681,754 B1 * 1/2004 Angeloni ..... 124/44.5
6,684,871 B1 * 2/2004 Troncoso et al. ..... 124/44.5
6,688,297 B1 * 2/2004 Clague ..... 124/44.5
6,763,820 B1 * 7/2004 Pinto, Jr. ..... 124/44.5
6,776,149 B1 * 8/2004 Beeks ..... 124/44.5
6,782,881 B2 * 8/2004 Mizek et al. ..... 124/44.5
6,789,536 B1 * 9/2004 Summers ..... 124/44.5
6,792,932 B2 * 9/2004 Musacchia, Jr. ..... 124/44.5

(Continued)

*Primary Examiner* — Gene Kim
*Assistant Examiner* — Alexander Niconovich
(74) *Attorney, Agent, or Firm* — Warn Partners, P.C.

(57) ABSTRACT

The present invention is an arrow holder operable for use with a drop down arrow rest, where the arrow holder is movable between a first position and second position. The arrow holder includes a lever portion, and a base portion formed as part of the lever portion; the lever portion and the base portion are operable for movement between a first position and a second position. Also included is a retaining hook operable for maintaining the lever portion and the base portion in the second position.

25 Claims, 7 Drawing Sheets

U.S. PATENT DOCUMENTS

| | | | | |
|---|---|---|---|---|
| 6,814,068 | B1 * | 11/2004 | Troncoso et al. | 124/44.5 |
| 6,823,856 | B2 * | 11/2004 | Rager | 124/44.5 |
| 6,913,008 | B2 * | 7/2005 | Simo et al. | 124/44.5 |
| 6,938,615 | B1 * | 9/2005 | Walker et al. | 124/44.5 |
| 6,948,488 | B2 * | 9/2005 | Afshari | 124/44.5 |
| 7,100,591 | B2 * | 9/2006 | Terry | 124/44.5 |
| 7,219,662 | B1 * | 5/2007 | Henry | 124/44.5 |
| 7,311,099 | B2 * | 12/2007 | Rager | 124/44.5 |
| 7,856,968 | B2 * | 12/2010 | Mizek et al. | 124/44.5 |
| 7,913,678 | B2 * | 3/2011 | Hudkins | 124/44.5 |
| 2006/0162709 | A1 * | 7/2006 | Roberts et al. | 124/44.5 |
| 2007/0221186 | A1 * | 9/2007 | Grace et al. | 124/44.5 |
| 2010/0006079 | A1 * | 1/2010 | Harwath et al. | 124/44.5 |

* cited by examiner

FIG. 10
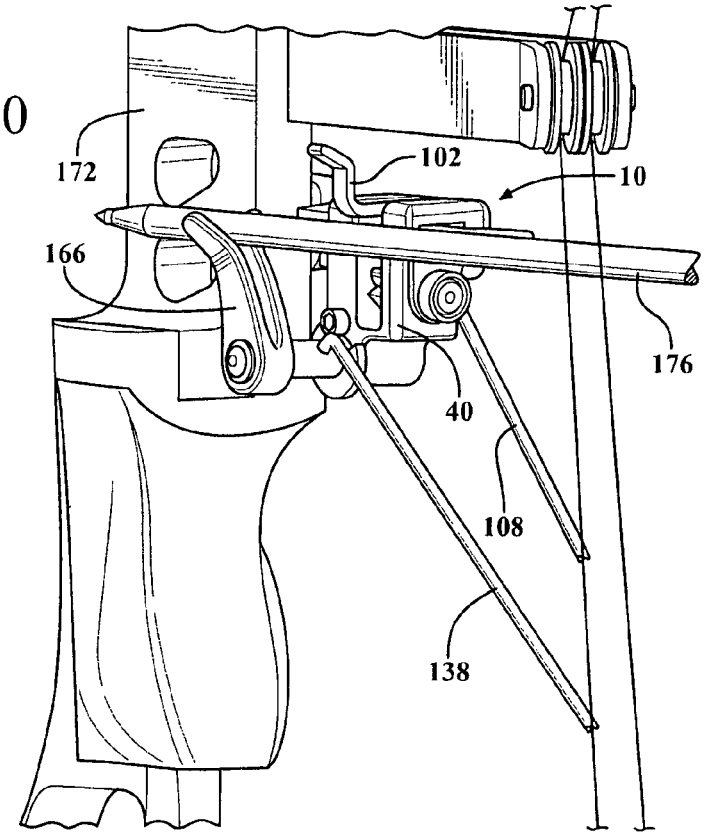
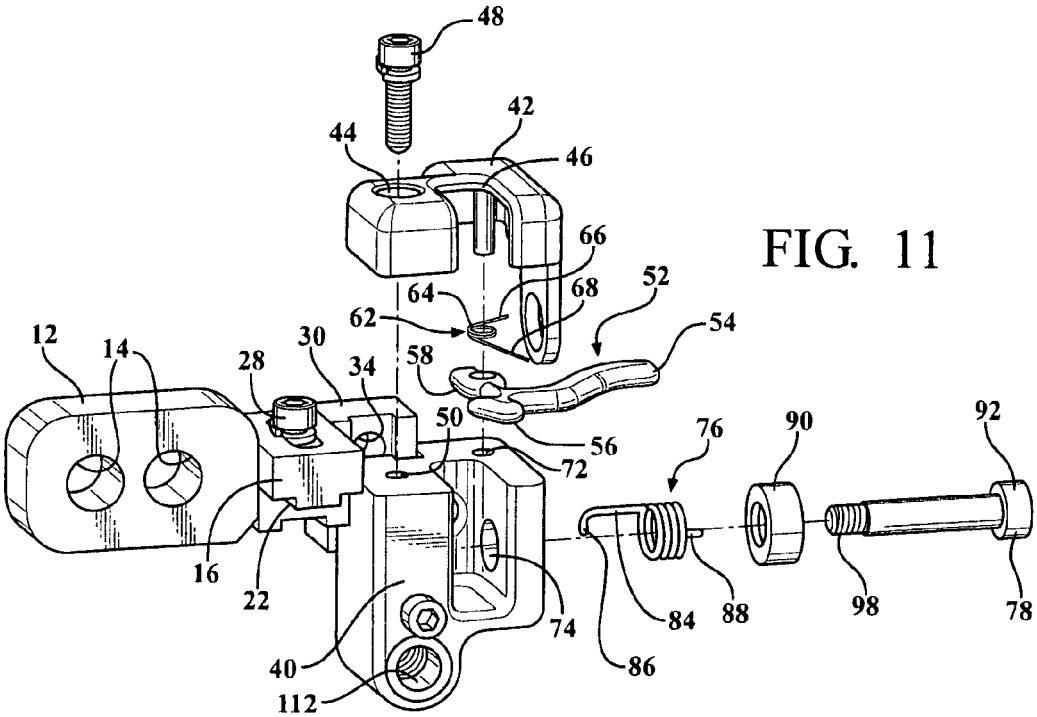
FIG. 11

ARROW REST WITH ARROW HOLDER

FIELD OF THE INVENTION

The present invention relates to an arrow holder used in combination with either a stationary or a "drop away" arrow rest for allowing a user to have the benefit of maintaining the position of the arrow on the arrow rest until the user is ready to discharge the arrow from a bow.

BACKGROUND OF THE INVENTION

Hunting with a bow and arrow is a popular and timeless approach for killing various types of wild game. Animals such as deer, turkey, bears, squirrels, rabbits, and the like are all hunted using a bow and arrow. Target shooting with a bow and arrow is also very popular.

Various arrow rest devices have been developed to improve the release of the arrow from the bow. One type of arrow rest is a stationary arrow rest, and another type is a "drop away" arrow rest, where the arrow rest is rotatable and has a resting location in which the arrow is located when the user is not ready to discharge the arrow, and a set of guides for supporting the arrow in the firing position when the user has drawn the bow. Upon release, the arrow rest rotates out of the way the instant the arrow fires such that the arrow rest no longer supports the arrow. In this manner, the arrow discharges from the bow without any friction from the arrow rest. However, one of the drawbacks to using this type of arrow rest is that when the arrow is placed in the resting location, there is nothing which supports the arrow to maintain the position of the arrow in the resting location when the bow is rotated, or moved. This results in the arrow being susceptible to becoming dislodged out of the firing ready position of the arrow rest, or the arrow may fall off entirely due to this dislodgement, which is considered undesirable by most who use a bow and arrow for activities such as target practice and hunting because there are often situations where it is desired to mount the arrow to the bow and leave the arrow in the bow for extended periods of time.

For example, when hunting, there are often situations where extended periods of time will pass before there is an opportunity for a clear shot at the animal being hunted. It is also desirable to make as little noise as possible in the woods so as not to provide the animal being hunted with any notice of the presence of the hunter. The hunter will often place an arrow onto the bow to have the bow and arrow ready when the opportunity is presented to avoid having to place the arrow onto the bow when the animal is within shooting range (thus avoiding making any unnecessary noise). However, when using the arrow rest as described above, the hunter must keep the bow in an upright position to prevent the arrow from becoming dislodged from the resting, fire ready position. Typically, a bow will rest on the user's lap and the arrow will not be in a fire ready position. The bow may also be hung from a hook, where the bow needs to tilt in order for the bow to be placed onto and removed from the hook. As this occurs, the arrow can become dislodged.

Accordingly, there exists a need for an arrow holder which is operable with a drop away arrow rest, but which also holds the arrow securely in a "fire ready" position.

SUMMARY OF THE INVENTION

The present invention is directed to an arrow holder operable for use with either a conventional arrow rest or a drop down arrow rest, where the arrow holder is movable between a first position and second position. The arrow holder includes a lever portion, and a base portion formed as part of the lever portion; the lever portion and the base portion are operable for movement between a first position and a second position. Also included is a retaining hook operable for maintaining the lever portion and the base portion in the second position.

The arrow holder is attached to the riser of an archery bow. When the arrow holder is in the first or down position, the arrow holder will maintain the position of an arrow in a groove formed as part of the drop down arrow rest, which allows the user to change the position of the bow without the arrow becoming dislodged from the groove. When the arrow is to be discharged, the bow string is pulled, and because the arrow holder is actuated by the bow string, the lever portion and base of the arrow holder are moved to the second or up position, and held in place by the retaining hook. Concurrently, the drop down arrow rest (which is also actuated by the bow string) also rotates such that the arrow is moved from the groove to being located between two guides which are also formed as part of the arrow rest. Once the bow string is released, the drop down arrow rest pivots such that the arrow rest is no longer in contact with the arrow so as to allow the arrow to be discharged with minimal to no friction.

After the arrow is discharged, the drop down arrow rest will return to the first or down position, but the arrow holder will remain in the second or up position until the retaining hook is actuated (i.e. moved to a displaced position), which will cause the lever portion and base portion to move from the second position back to the first position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 10 is an enlarged view of a bow and arrow incorporating an arrow holder and a drop down arrow rest, according to the present invention; and FIG. 11 is a second exploded view of an arrow holder and a drop down arrow rest, according to the present invention.

DETAILED DESCRIPTION OF THE PREFERRED EMBODIMENTS

Figure 1:
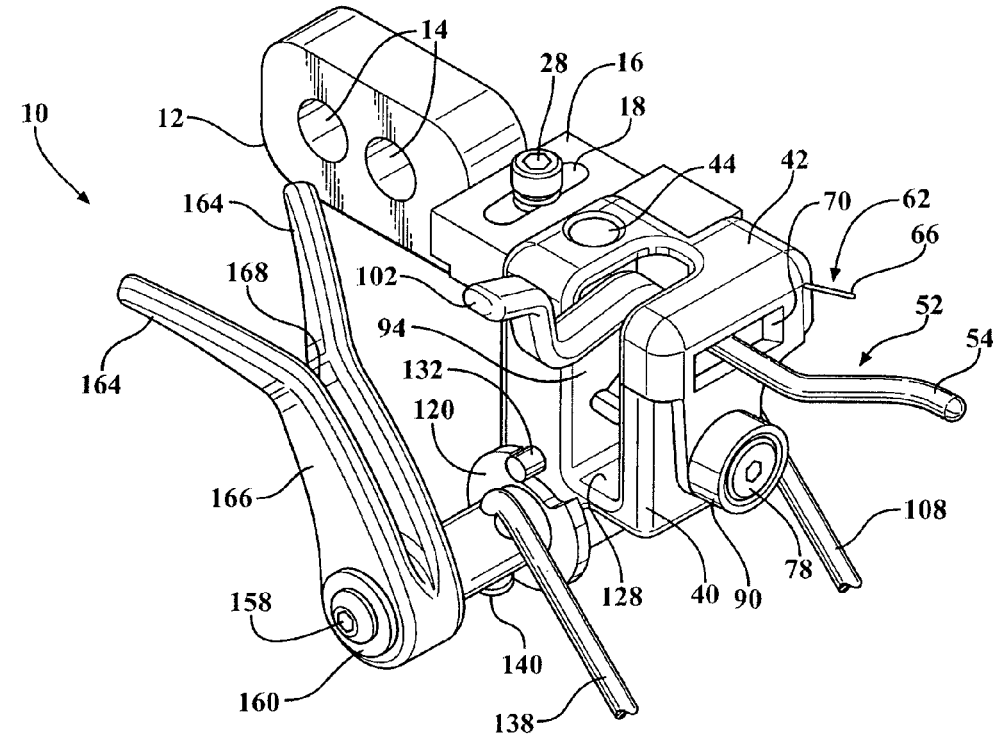
FIG. 1 is a perspective view of an arrow holder and a drop down arrow rest in an up position, according to the present invention.

The following description of the preferred embodiment(s) is merely exemplary in nature and is in no way intended to limit the invention, its application, or uses.

A drop away arrow rest with arrow holder is shown in the Figures generally at 10. The arrow holder 10 is moveable between a first position, or more specifically, a down or "rest" position shown in FIGS. 3-7, and a second position, or more specifically, an up or "shooting" position, shown in FIGS. 1-2. The arrow holder 10 includes a mounting block 12 which includes a pair of apertures 14 which allow the mounting block 12 to be mounted to an archery bow riser 172. Formed as part of the mounting block 12 is a first adjustment, block 16 having a slot 18. The first adjustment block 16 is operable with a second adjustment block 20 for adjusting the position of the arrow holder 10 relative to the bow riser 172 along a first axis 21. The first adjustment block 16 is substantially T-shaped, and has a lower protrusion 22 which is operable to be received into a correspondingly shaped groove 24 formed as part of the second adjustment block 20. The second adjustment block 20 also includes a threaded aperture 26; and there is a fastener in the form of a lock washer socket head cap screw 28 which extends through the slot 18 and into the threaded aperture 26. When the screw 28 is loosened, the first adjustment block 16 is operable to slide in the groove 24 while allowing the screw 28 to remain at least partially inserted into the threaded aperture 26, this allows the first adjustment block 16 to be adjusted relative to the second adjustment block 20, the function of which will be described later.

The second adjustment block 20 is formed with a third adjustment block 30 as a single component, which also has a groove 32, similar to the groove 24 mentioned above. There is also a slot 34 formed as part of the third adjustment block 30 and extends along the bottom of the groove 32, which is operable for receiving a fastener, which in this embodiment is another lock washer socket head cap screw 36. The groove 32 is operable for receiving a corresponding lower protrusion 38, similar to the lower protrusion 22 mentioned above. The corresponding lower protrusion 38 is formed as part of a main body or main block 40. There is also a threaded aperture (not shown) formed as part of the corresponding lower protrusion 38, the screw 36 is operable to extend through the slot 34 and into the threaded aperture formed as part of the lower protrusion 38. When the screw 36 is loose, the third adjustment block 30 is able slide relative to the main block 40 via the protrusion 38 sliding in the groove 32 and the screw 36 moving in the slot 34, allowing the holder 10 to move relative to the bow riser 172 along a second axis 41. When the third adjustment block 30 and the main block 40 are in desired positions relative to one another, the screw 36 is tightened, securing the position of the third adjustment block 30 relative to the main block 40.

Also connected to the main block 40 is a cover 42 having an aperture 44 and a recess 46. Another lock washer socket head cap screw 48 is inserted through the aperture 44 into a corresponding threaded aperture 50 formed in the main block 40; once the screw 48 is tightened, the cover 42 is secured to the main block 40.

There is a release mechanism in the form of a retaining hook 52 having a lever 54, a latch 56, and an extension 58 which includes an aperture 60. The retaining hook 52 is substantially positioned between the cover 42 and the main block 40. A first return spring 62 is wound to form a spring aperture 64 between a first lever portion 66 and a second lever portion 68. The first lever portion 66 extends out of an aperture 70 formed in the cover 42, and the second lever portion 68 is connected to the retaining hook 52. There is a protrusion (not shown) extending from the inside of the cover 42 and through the spring aperture 64, the aperture 60 formed as part of the extension 58, and into a non-threaded aperture 72 formed as part of the main block 40. The retaining hook 52 is biased toward a rest position because of the first return spring 62, but is movable to a displaced position, the function of which will be described later.

Formed on the side of the main block 40 is a shoulder aperture 74, which is operable for receiving a second return spring 76 and a precision shoulder screw 78. There is also a side aperture 80 formed as part of the cover 42. The second return spring 76 is wound to have a coil portion 82 disposed between a first extension 84 having a hook 86 and a second extension 88. When assembled, the screw 78 extends through a cup washer 90, then through the side aperture 80, and the coil portion 82 of the second return spring 76 and the shoulder aperture 74. The coil portion 82 of the spring 76 is also disposed in the shoulder aperture 74 such that the coil portion 82 is concentric with a portion of the screw 78. The second extension 88 extends into an aperture (not shown) formed as part of the cup washer 90 to anchor the second extension 88 to the cup washer 90, this prevents the second extension 88 from rotating with the rest of the spring 76 because when the screw 78 is tightened, the cup washer 90 will be secured between the head 92 of the screw 78 and the side of the cover 42 as shown in FIGS. 1-7.

The screw 78 also extends through a recess 94 formed as part of the main block 40 and into a threaded aperture 96. One end of the screw 78 also has a threaded portion 98 which is received into the threaded aperture 96 for tightening the screw 78 into a secured position.

The first extension 84 and hook 86 extend around a lever portion 100 of an arrow holder 102, and bias the arrow holder 102 toward the down or rest position, best seen in FIGS. 3-7. The arrow holder 102 also includes a base portion 104 having an aperture 106. When the screw 78 is in the secured position mentioned above, the screw 78 also extends through the aperture 106 such that the arrow holder 102 is positioned near, but does not contact, a bottom surface 128 of the recess 94. However, the screw 78 is not connected to the base portion 104 such that the arrow holder 102 is allowed to pivot about the screw 78 against the resistance of the spring 76. There is also a string or rope 108 which extends through an aperture (not shown) formed in the lever portion 100, and is prevented from being pulled entirely through the aperture formed in the lever portion 100 by a knot 110. The string 108 also extends through an aperture (not shown) formed in the main block 40, the function of which will be described later.

The main block 40 also has a large lower aperture 112 operable for receiving a third return spring 114 disposed between two sleeve bearings 116, which are also received into the lower aperture 112. The third return spring 114 and the sleeve bearings 116 are mounted upon a pin 118, one of the sleeve bearings 116 is mounted on the pin 118 adjacent a flange 120. The pin 118 also includes a receiving aperture 122 which is used for receiving a first anchor extension 124 formed as part of the third return spring 114. The return spring 114 also includes a second anchor extension 126 which extends away from the return spring 144 in a tangential manner such that the second anchor extension 126 will extend into a slot (not shown) formed as part of the lower aperture 112, allowing the third return spring 114 to bias the rotation of the pin 118 in the down or rest position, as mentioned above.

The flange 120 has a U-shaped cut-out portion 130, and the flange 120 is then operable with a stopper 132 for limiting the rotation of the pin 118. The stopper 132 is partially disposed in a small lower aperture 134. As the pin 118 rotates, the degree of rotation will be limited by the stopper 132 contacting the edges of the cut-out portion 130 formed in the flange.

The pin 118 also has an aperture 136 extending through the pin 118, which allows another string or rope 138 to extend through the aperture 136. In a similar manner to the string 108 described above, the string 138 is prevented from being pulled entirely through the aperture 136 formed in the pin 118 by a knot 140 or other stop such as a melted portion at the end of the string 138. The string 138 partially extends around the pin 118 as shown in FIGS. 1-7, the function of which will be described later.

Figure 8:
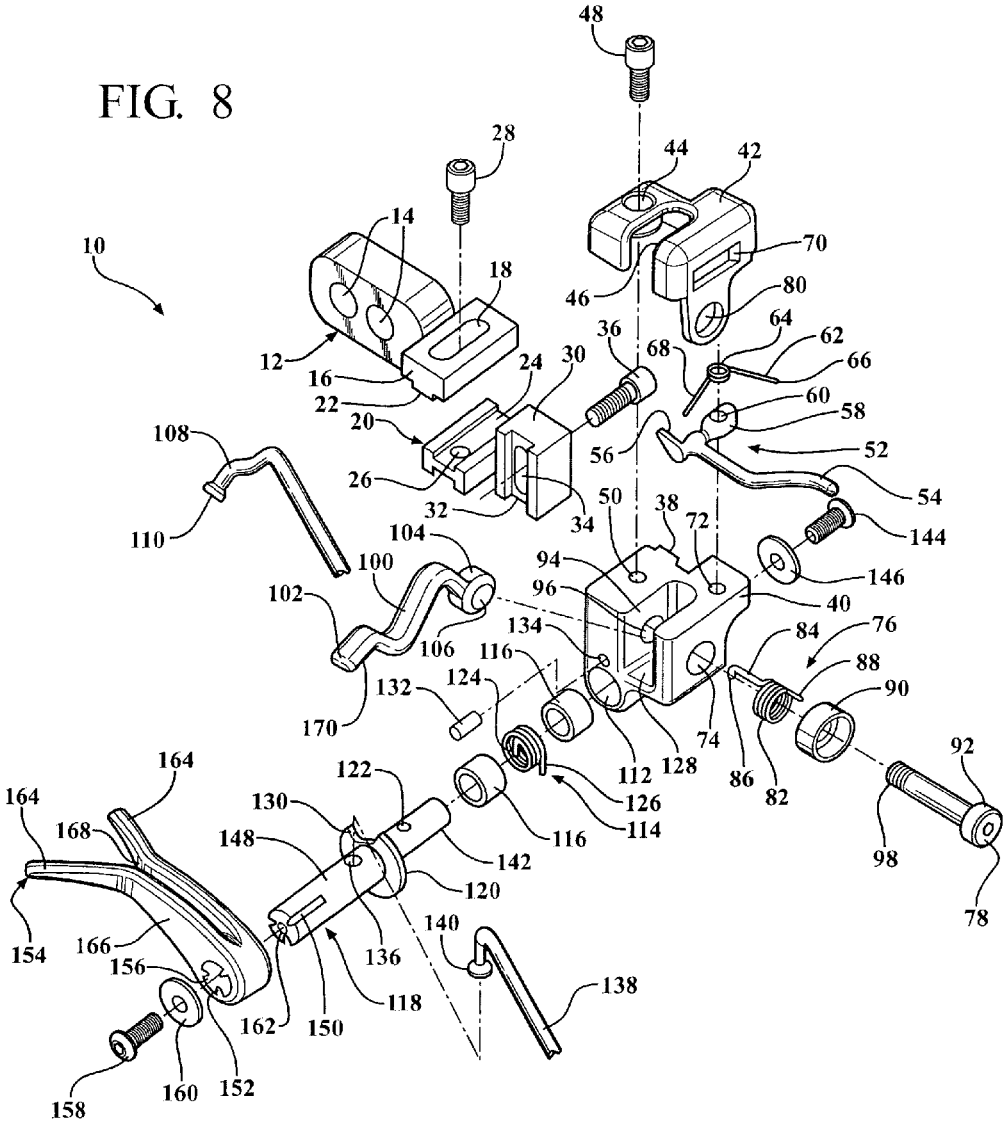
FIG. 8 is a first exploded view of an arrow holder and a drop down arrow rest, according to the present invention.
Figure 9:
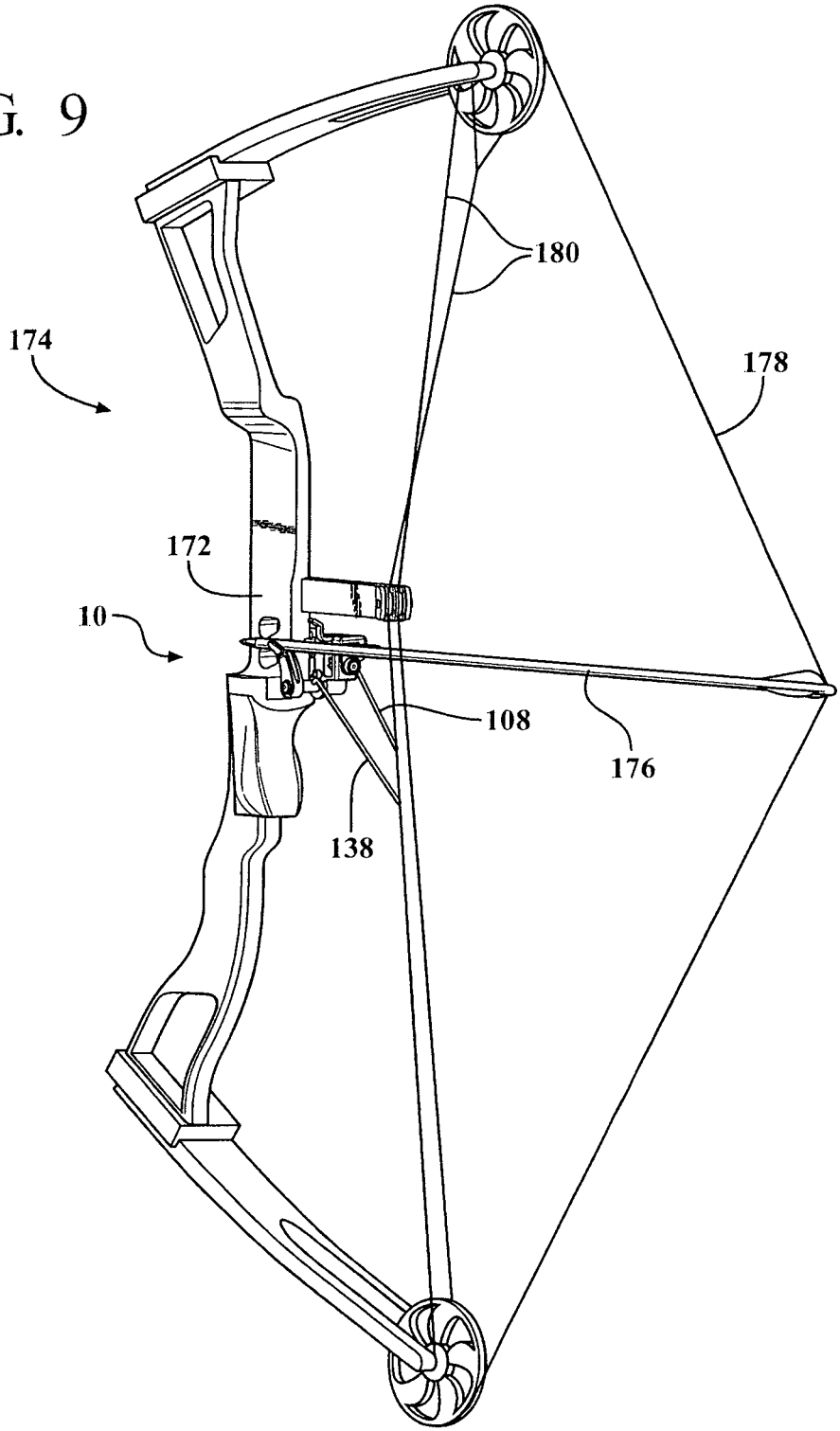
FIG. 9 is a perspective view of a bow and arrow incorporating an arrow holder and a drop down arrow rest, according to the present invention.

The portion of the pin 118 upon which the bearings 116 and the third return spring 114 are mounted is the small diameter portion 142, which extends through the main block 40, where there is a button socket head cap screw 144 which extends through a washer 146 into the end of the small diameter portion 142 of the pin 118 to prevent the pin 118 from being pulled out of the main block 40. The pin 118 also includes a large diameter portion 148 which includes three slots 150 which are equally spaced around the large diameter portion 148 as shown in FIG. 8, which receive a set of corresponding tabs 152 formed as part of an arrow rest 154, and the tabs 152 are formed in an aperture 156. The tabs 152 and slots 150 prevent the rest 154 from rotating relative to the pin 118 when the rest 154 is mounted on the pin 118, and the tabs 152 are disposed in the slots 150. To prevent the rest 154 from sliding off of the pin 118, there is another button socket head cap screw 158 which extends through a washer 160 and into a threaded aperture 162 formed on an end portion of the large diameter portion 148 of the pin 118.

The rest 154 includes a pair of guides 164 which extend into a body portion 166 and a groove 168. The groove 168 is used for supporting an arrow 176 in the down (or resting) position, and the guides 164 are used for supporting the arrow 176 in the up (or shooting) position. While the arrow holder 102 has been described for use with an arrow rest 154 that is rotatable between down and up positions, the arrow holder 102 of the present invention is also useable with an arrow rest that is in a fixed position.

In operation, the arrow holder 10 is in the down position shown in FIGS. 3-7. The rest 154 is rotated forward, and the lever portion 100 of the arrow holder 102 is located downward when looking at FIGS. 3-7. In an alternate embodiment, a stopper (not shown) is formed as part of the base portion 104 such that the stopper will contact the bottom surface 128 when the arrow holder 102 is when the arrow holder 102 is in the position shown in FIGS. 3-7. In the down position, an arrow 176 is held in the groove 168 by a curved portion 170 of the lever portion 100. This allows the user of the archery bow riser 172 to rotate and otherwise move the riser 172 without the arrow 176 becoming dislocated.

When the user decides to draw the bow 174 and shoot the arrow 176, the bow string 178 is pulled back, which draws a set of cables 180, thereby causing the strings 108, 138 to be pulled as well. When the string 108 attached to the lever portion 100 of the arrow holder 102 is pulled, the lever portion 100 rotates about the precision shoulder screw 78 because of the screw 78 extending through the aperture 106 of the base portion 104. The lever portion 100 rotates against the resistance of the second return spring 76 because of the first extension 84 being located against the lever portion 100 and the second extension 88 being held in place by the cup washer 90 and screw 78. The continued pulling of the string 108 causes the lever portion 100 to lift and move past the latch 56 of the retaining hook 52; the retaining hook 52 is shaped such that as the lever portion 100 lifts, the lever portion 100 contacts the latch 56 and applies pressure to the latch 56, causing the retaining hook 52 to pivot against the force of the first return spring 62 to the displaced position. This movement continues until the lever portion 100 has moved in the recess 94 past the latch 56, upon which the retaining hook 52 moves back to the rest position, and the lever portion 100 is held in the up position by the latch 56.

Figure 2:
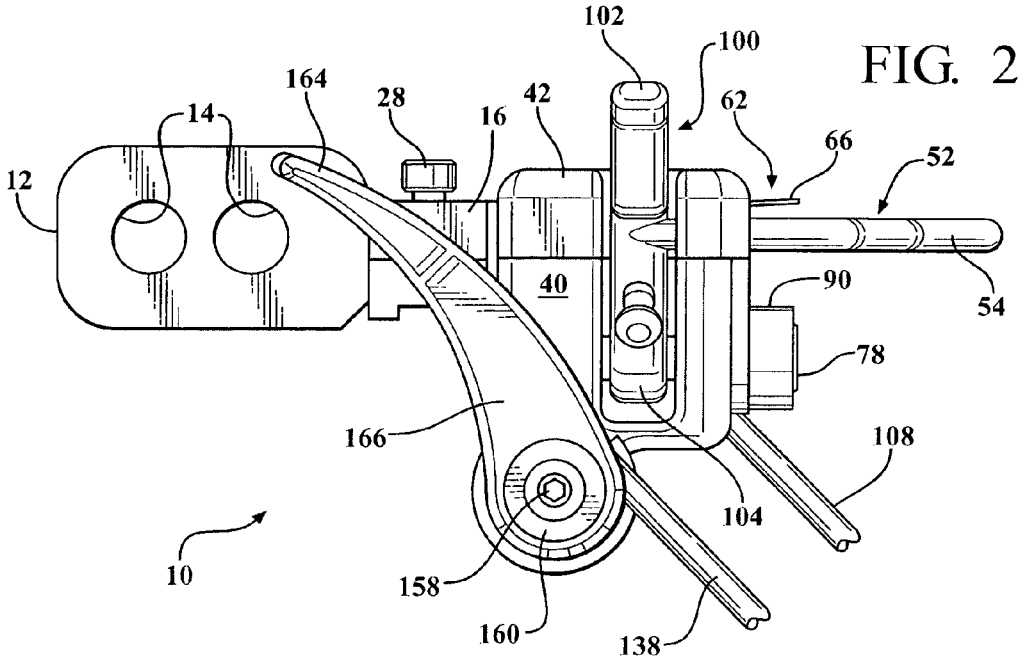
FIG. 2 is a side view of an arrow holder and a drop down arrow rest in an up position, according to the present invention.
Figure 3:
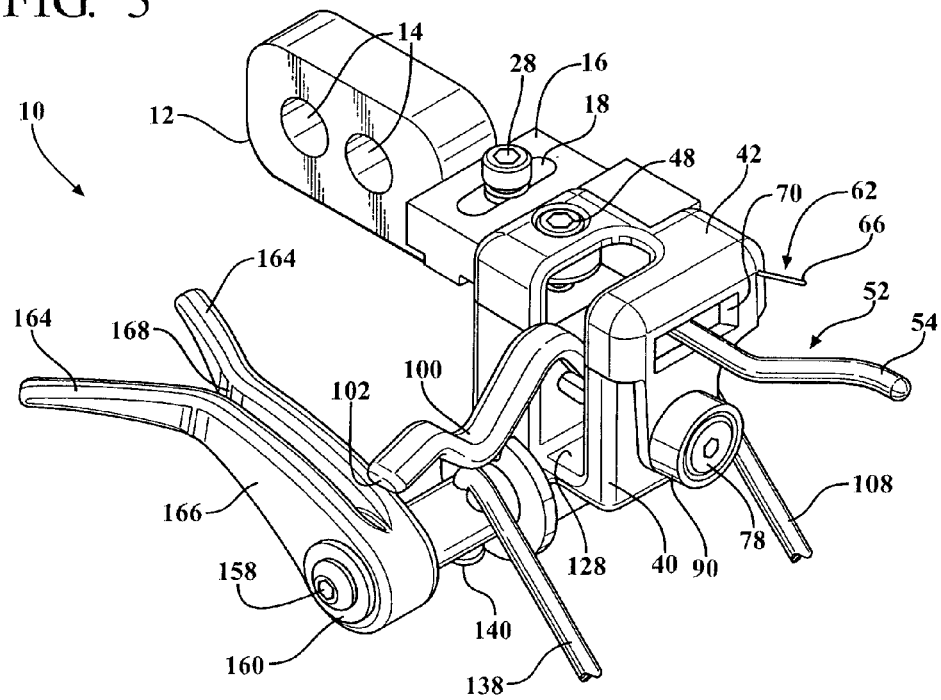
FIG. 3 is a perspective view of an arrow holder and a drop down arrow rest in a down position, according to the present invention.
Figure 4:
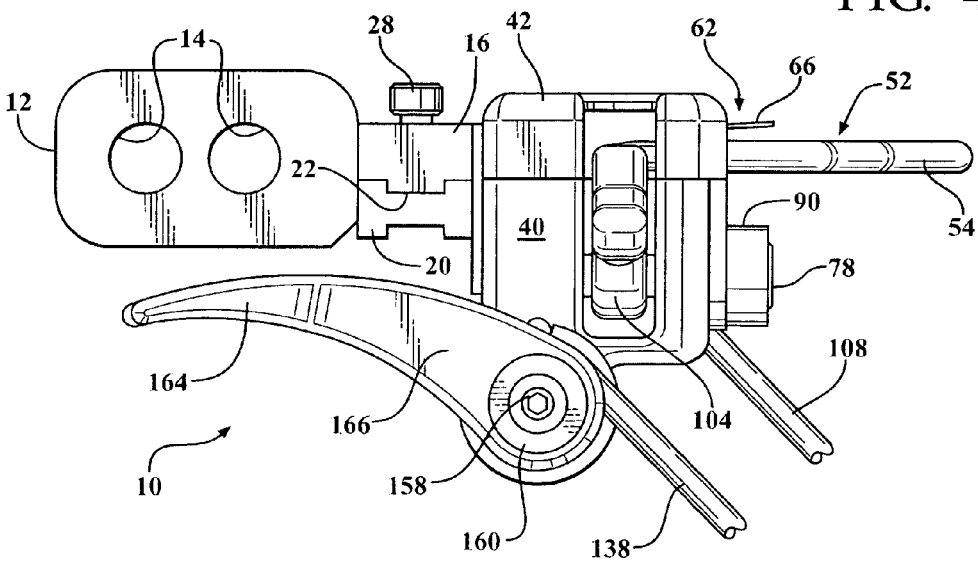
FIG. 4 is a side view of an arrow holder and a drop down arrow rest in a down position, according to the present invention.
Figure 5:
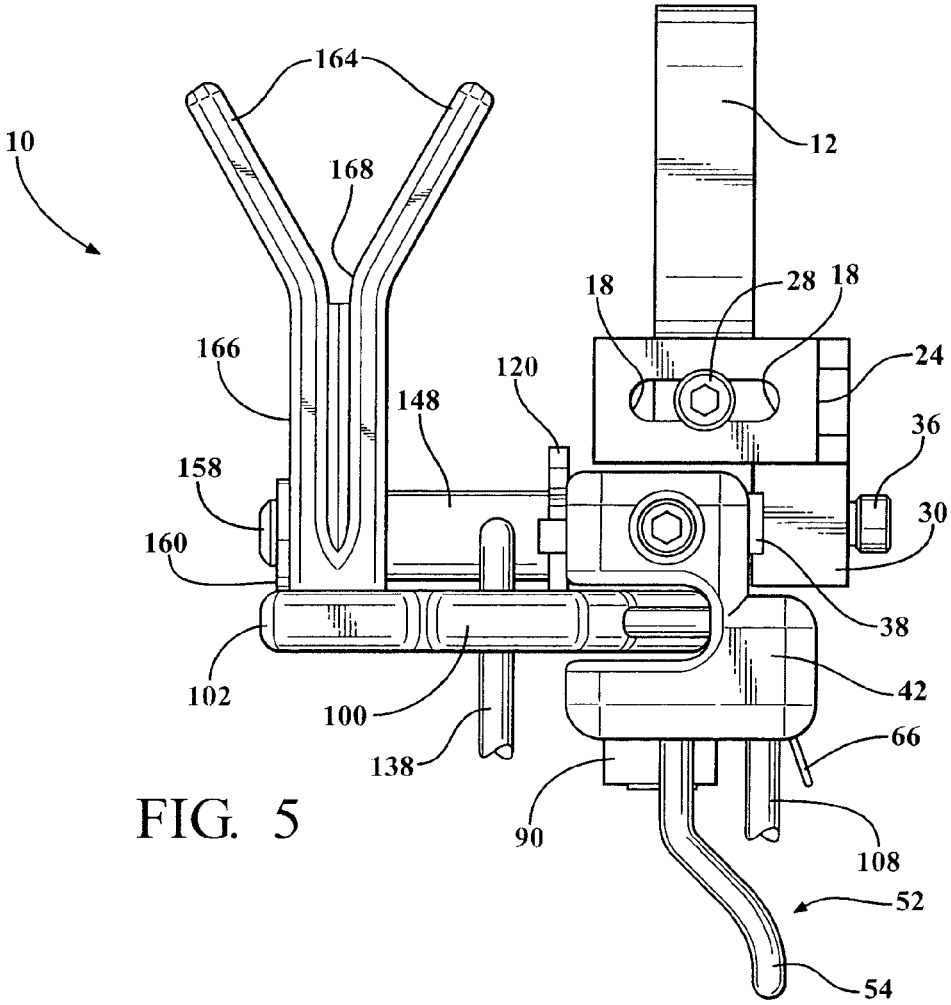
FIG. 5 is a top view of an arrow holder and a drop down arrow rest in a down position, according to the present invention.
Figure 6:
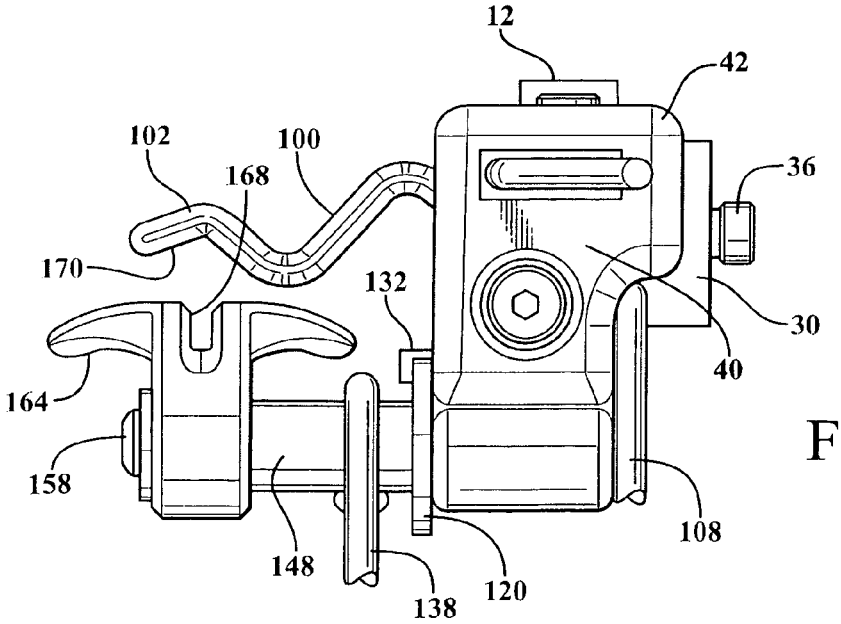
FIG. 6 is a rear view of an arrow holder and a drop down arrow rest in a down position, according to the present invention.
Figure 7:
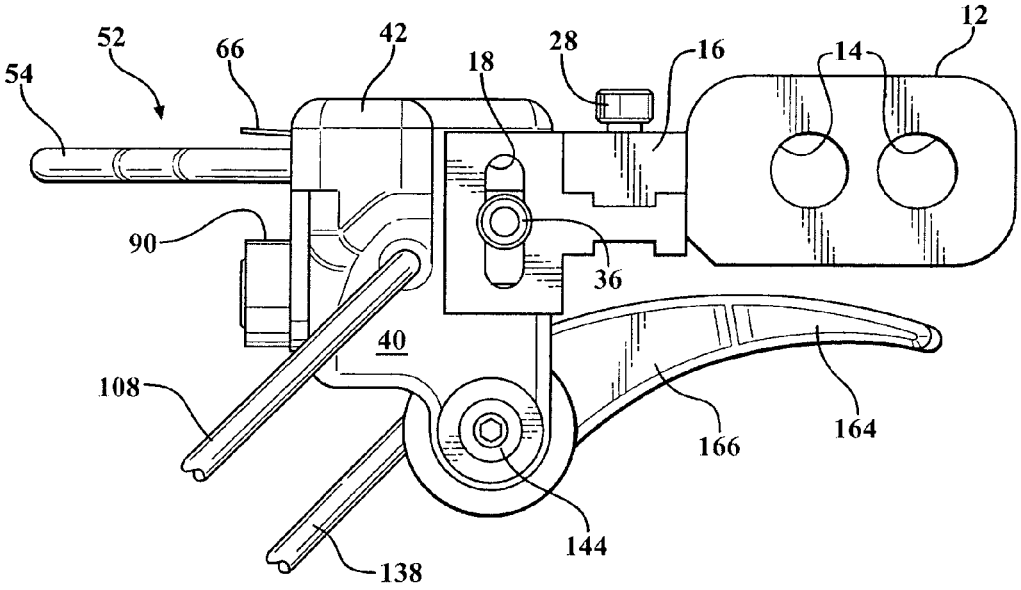
FIG. 7 is a second side view of an arrow holder and a drop down arrow rest in a down position, according to the present invention.

Simultaneously, the string 138 is also pulled, which causes the pin 118 to rotate against the force of the third return spring 114. This in turn causes the rest 154 to rotate as well to the up position as shown in FIGS. 1-2. As this occurs, the arrow 176 lifts and changes position from being located in the groove 168 to being located between the guides 164. Once the bow 174 is drawn, the arrow holder 10 is in the up or shooting position, the user then releases, and the tension in both strings 108, 138 is released, and the force of the third return spring 114 results in the rotation of the pin 118, and therefore the rest 154 returns to the down or rest position as shown in FIGS. 3-7. This occurs as the arrow 176 is discharged from the bow 174.

However, when the user releases the bow string 178, the tension on the string 108 is released as mentioned above, but the lever portion 100 will remain in the up or shooting position as shown in FIGS. 1-2 because the latch 56 of the retaining hook 52 prevents the arrow holder 102 from rotating back to the down or rest position, even though the rest 154 has returned to the down or rest position. More specifically, the latch 56 holds the lever portion 100 in the up or shooting position, even after the string 178 of the bow 174 is released. The purpose of this is to allow the user to place another arrow 176 into the groove 168. Once the arrow 176 is placed in the groove 168, the user will apply a force to the lever 54 of the retaining hook 52 against the force of the first return spring 62 to move the retaining hook 52 from the rest position to the displaced position, which causes the latch 52 to no longer be in contact with the lever portion 100 of the arrow holder 102. The second return spring 76 then causes the arrow holder 102 to pivot about the screw 78 such that the curved portion 170 of the arrow holder 102 contacts the arrow 176, thereby maintaining the position of the arrow 176 between the curved portion 170 and the groove 168. This allows the user to change the position of the bow 174, or rotate and otherwise move the riser 172 while the arrow 176 remains in the same position. When the user is ready to discharge the arrow 176, the user will draw the bow 174, and the process as described above is repeated.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. An arrow holder operable for use with an arrow rest, said arrow holder being movable between a first position and second position, comprising:

a lever portion;

a base portion formed as part of said lever portion, said lever portion and said base portion operable for movement between a first position and a second position;

a string attached to said lever portion such that when said string is pulled before discharge of an arrow said lever portion moves to said second position out of contact with said arrow;

a retaining hook operable for maintaining said lever portion and said base portion in said second position; and a drop down arrow rest movable between a first position and a second position, and when said drop down arrow rest is in said second position, said drop down arrow rest is in an up or shooting position with said arrow located in said drop down arrow rest and said lever portion being in said second position out of contact with said arrow.

2. The arrow holder operable for use with an arrow rest, said arrow holder being movable between a first position and second position of claim 1, said retaining hook further comprising:

a lever;

a latch connected to said lever; and an extension connected to said lever, wherein said retaining hook is pivotable about said extension between a rest position and a displaced position, such that as said lever portion is moved from said first position to said second position, said lever portion will contact said lever and cause said retaining hook to pivot about said extension and move to said displaced position, such that once said lever portion and said base portion move to said second position, and said retaining hook returns to said rest position, and said latch contacts said lever portion and maintains said lever portion and said base portion in said second position.

3. The arrow holder operable for use with an arrow rest, said arrow holder being movable between a first position and second position of claim 2, further comprising a first return spring operable for biasing said retaining hook toward said rest position.

4. The arrow holder operable for use with an arrow rest, said arrow holder being movable between a first position and second position of claim 1, further comprising a second return spring operable for biasing said lever portion and said base portion toward said first position.

5. The arrow holder operable for use with arrow rest, said arrow holder being movable between a first position and second position of claim 1, further comprising:

a main block, said arrow holder operable for being mounted to said main block;

a recess formed as part of said main block, said lever portion being operable for pivoting in said recess between said first position and said second position; and said arrow rest connected to said main block, said lever portion extends from said recess and maintains the position of an arrow located in said arrow rest.

6. The arrow holder operable for use with an arrow rest, said arrow holder being movable between a first position and second position of claim 5, further comprising a curved portion formed as part of said lever portion, said curved portion operable for maintaining the position of said arrow in said arrow rest of said main block.

7. The arrow holder for use with an arrow rest, said arrow holder being movable between a first position and second position of claim 6, said arrow rest being a drop down arrow rest, further comprising:

said drop down arrow rest being pivotable in relation to said main block between said first position and said second position; and a groove formed as part of said drop down rest operable for receiving a portion of an arrow when said drop down arrow rest is in said first position, said curved portion maintains the position of said arrow in said groove.

8. The arrow holder operable for use with an arrow rest, said arrow holder being movable between a first position and second position of claim 7, further comprising at least one guide formed as part of said drop down arrow rest, wherein said arrow moves from being disposed in said groove to being supported by said at least one guide when said drop down arrow rest moves from said first position to said second position, and said curved portion maintains the position of said arrow in said guide.

9. The arrow holder operable for use with an arrow rest, said arrow holder being movable between a first position and second position of claim 7, further comprising:

a pin at least partially disposed in said main block in a rotatable manner; and an aperture formed as part of said drop down arrow rest, a portion of said pin operable for being received by said aperture, wherein said drop down arrow rest is mounted on said pin such that said pin and said drop down arrow rest are rotatable relative to said main block between said first position and said second position.

10. The arrow holder operable for use with an arrow rest, said arrow holder being movable between a first position and second position of claim 5, further comprising:

a mounting block operable for mounting said arrow holder to the riser of a bow;

a first adjustment block formed as part of said mounting block;

a second adjustment block operable with said first adjustment block such that said first adjustment block is operable to be moved relative to said second adjustment block to change the position of said arrow holder relative to said riser along a first axis; and a third adjustment block formed with said second adjustment block as a single component, the position of said third adjustment block being selectively connected and adjustable relative to said main block to change the position of said arrow holder relative to said riser along a second axis.

11. An arrow holder operable for use with a drop down arrow rest, comprising:

a lever portion;

a base portion, said base portion and said lever portion formed as a single component, said lever portion and said base portion operable for movement between a first position and a second position;

a string attached to said lever portion such that when said string is pulled before discharge of an arrow, said lever portion moves to said second position;

a retaining hook movable between a rest position and a displaced position, said retaining hook being operable for maintaining said lever portion and said base portion in said second portion;

a main block having a recess, said arrow holder being mounted to said main block such that said lever is operable to pivot in said recess between said first position and said second position; and a drop down arrow rest in a pivot relationship with said main block such that said drop down arrow rest pivots between said first position and said second position, and when said drop down arrow rest is in said first position, said lever portion selectively extends from said recess and maintains the position of an arrow located in said drop down arrow rest, and when said drop down arrow rest is in said second position, said drop down arrow rest is in an up or shooting position with said arrow located in said drop down arrow rest and said lever portion up and not in contact with said arrow.

12. The arrow holder operable for use with a drop down arrow rest of claim 11, said retaining hook further comprising:

a lever;

a latch;

a first return spring operably connected to said lever for biasing said retaining hook from said displaced position to said rest position; and an extension formed with said latch and said lever as a single component such that said lever, said latch, and said extension are pivotable between said rest position and said displaced position, wherein as said lever portion is moved from said first position to said second position, said lever will contact said latch and cause said retaining hook to move from said rest position to said displaced position, and once said lever portion has reached said second position, said retaining hook will return to said rest position and maintain said lever portion in said second position.

13. The arrow holder operable for use with a drop down arrow rest of claim 11, said drop down arrow rest further comprising:

a groove operable for receiving at least a portion of an arrow when said drop down arrow rest is in said first position; and a plurality of guides formed as part of said drop down arrow rest, wherein said arrow will move from being supported by said groove to being disposed between two of said plurality of guides when said drop down arrow rest moves from said first position to said second position.

14. The arrow holder operable for use with a drop down arrow rest of claim 13, further comprising a curved portion formed as part of said lever portion, said curved portion operable for maintaining the position of said arrow in said groove when said lever portion and said drop down arrow rest are in said first position.

15. The arrow holder operable for use with a drop down arrow rest of claim 11, further comprising a second return spring operably connected to said lever portion such that said lever portion and said base portion are biased towards said first position.

16. The arrow holder operable for use with a drop down arrow rest of claim 11, further comprising:

a pin at least partially extending into said main block, said pin being able to rotate relative to said main block;

one or more bearings surrounding the portion of said pin at least partially extending into said main block for providing relative rotation between said pin and said main block; and an aperture formed as part of said drop down arrow rest, wherein a portion of said pin extends into said aperture formed as part of said drop down arrow rest, and said relative rotation between said pin and said main block provides for relative rotation between said drop down arrow rest and said main block such that said drop down arrow rest is movable between said first position and said second position.

17. The arrow holder operable for use with a drop down arrow rest of claim 16, further comprising a third return spring operable for biasing said pin and said drop down arrow rest toward said first position.

18. The arrow holder operable for use with a drop down arrow rest of claim 11, further comprising:

a mounting block operable for connection with a riser of a bow;

a first adjustment block formed as part of said mounting block, said first adjustment block having a slot and a lower protusion formed as part of said first adjustment block;

a second adjustment block having an aperture and a groove formed as part of said second adjustment block, said aperture formed in said groove such that said groove is operable for receiving said lower protrusion of said first adjustment block to adjust the position of said first adjustment block relative to said second adjustment block along a first axis, and one of a plurality of fasteners is operable for extending through said slot formed as part of said first adjustment block and into said aperture formed as part of said second adjustment block to secure the position of said first adjustment block relative to said second adjustment block; and a third adjustment block formed as a single component with said second adjustment block, said third adjustment block having a slot disposed in a groove formed as part of said third adjustment block, said groove of said third adjustment block operable for receiving a lower protrusion formed as part of said main block for adjusting the position of said third adjustment block relative to said main block along a second axis, and one of said plurality of fasteners is operable for extending through said slot of said third adjustment block into an aperture formed as part of said main block to secure the position of said third adjustment block relative to said main block.

19. An arrow holder operable for use with a drop down arrow rest, comprising:

a lever portion;

a base portion, said base portion and said lever portion formed as a single component, said lever portion and said base portion operable for movement between a first position and a second position;

a lever having a latch formed as part of said lever;

an extension formed as part of said lever such that said lever is pivotable between a rest position and a displaced position about said extension, said latch being operable for maintaining said lever portion and said base portion in said second position;

a string attached to said lever portion such that when said string is pulled before discharge of an arrow, said lever portion moves to said second position;

a main block having a recess, said arrow holder being mounted to said main block such that said lever is operable to pivot in said recess between said first position and said second position;

a drop down arrow rest pivotable relative to said main block between said first position and said second position, such that when said drop down arrow rest is in said first position said lever portion selectively pivots in said recess towards said drop down arrow rest and maintains the position of an arrow supported by said drop down arrow rest, and when said drop down arrow rest is in said second position, said drop down arrow rest is in an up or shooting position with said arrow located in said drop down arrow rest and said lever portion is up and not in contact with said arrow; and a first return spring operable for biasing said lever, said latch, and said extension towards said first position.

20. The arrow holder operable for use with a drop down arrow rest of claim 19, further comprising a second return spring connected to said lever portion, wherein said second return spring is operable for biasing said lever portion toward said first position.

21. The arrow holder operable for use with a drop down arrow rest of claim 20, said lever portion further comprising a curved portion formed as part of said lever portion, said curved portion operable for maintaining the position of said arrow in said drop down arrow holder when said second return spring biases said lever portion toward said first position.

22. The arrow holder operable for use with a drop down arrow rest of claim 19, said lever portion further comprising:

a pin at least partially extending into said main block, said pin being able to rotate relative to said main block;

a small diameter portion forming a part of said pin, said small diameter portion of said pin at least partially extending into said main block;

one or more bearings surrounding said small diameter portion of said pin at least partially extending into said main block for providing relative rotation between said pin and said main block;

a large diameter portion forming a part of said pin; and an aperture formed as part of said drop down arrow rest, wherein said large diameter portion of said pin extends into said aperture formed as part of said drop down arrow rest, and said relative rotation between said pin and said main block provides for relative rotation between said drop down arrow rest and said main block such that said drop down arrow rest is movable between said first position and said second position.

23. The arrow holder operable for use with a drop down arrow rest of claim 22, further comprising a third return spring surrounding and connected to said small diameter portion of said pin adjacent said one or more bearings, said third return spring operable for biasing said pin and said drop down arrow rest toward said first position.

24. The arrow holder operable for use with a drop down arrow rest of claim 22, said drop down arrow rest further comprising:

a plurality of tabs formed in said aperture operable for being received into a respectively plurality of slots formed in said aperture operable for being received into a respectively plurality of slots formed on said large diameter portion of said pin;

a groove operable for receiving at least a portion of an arrow when said drop down arrow rest is in said first position; and a plurality of guides formed as part of said drop down arrow rest, wherein said arrow will move from being supported by said groove to being disposed between two of said plurality of guides when said pin rotates and moves said drop down arrow rest from said first position to said second position.

25. The arrow holder operable for use with a drop down arrow rest of claim 19, further comprising:

a mounting block operable for connection with a riser of a bow;

a first adjustment block formed as part of said mounting block;

a slot formed as part of said first adjustment block;

a lower protrusion formed as part of said first adjustment block, said slot formed as part of said first adjustment block extending through said first adjustment block and through said lower protrusion formed as part of said first adjustment block;

a second adjustment block;

a groove formed as part of said second adjustment block;

an aperture formed as part of said second adjustment block, said aperture formed in said groove formed as part of said second adjustment block such that said groove formed as part of said second adjustment block is operable for receiving said lower protrusion of said first adjustment block to adjust the position of said first adjustment block relative to said second adjustment block along a first axis, and one of a plurality of fasteners is operable for extending through said slot formed as part of said first adjustment block and into said aperture formed as part of said second adjustment block to secure the position of said first adjustment block relative to said second adjustment block; and a third adjustment block formed as a single component with said second adjustment block;

a groove formed as part of said third adjustment block;

a slot disposed in said groove formed as part of said third adjustment block, and extending through said third adjustment block; and a lower protrusion formed as part of said main block, wherein said groove of said third adjustment block is operable for receiving said lower protrusion formed as part of said main block for adjusting the position of said third adjustment block relative to said main block along a second axis, and one of said plurality of fasteners is operable for extending through said slot formed as part of said third adjustment block into an aperture formed as part of said main block to secure the position of said third adjustment block relative to said main block.

* * * * *

UNITED STATES PATENT AND TRADEMARK OFFICE

CERTIFICATE OF CORRECTION

PATENT NO. : 8,474,443 B2
APPLICATION NO. : 12/653434
DATED : July 2, 2013
INVENTOR(S) : Ray Edward Geno It is certified that error appears in the above-identified patent and that said Letters Patent is hereby corrected as shown below:

In the Specification

Column 3,
Line 54, insert -- to -- after -- able --.

Column 5,
Line 55, delete second occurrence of "when the arrow holder 102".

In the Claims

Column 11, Claim 24
Line 38, "respectively" should be -- respective --.

Column 11, Claim 24
Line 40, "respectively" should be -- respective --.

Column 12, Claim 25
Line 30, delete "and".

Signed and Sealed this
First Day of July, 2014

Michelle K. Lee

Michelle K. Lee
*Deputy Director of the United States Patent and Trademark Office*